United States Patent [19]

Dedmon

[11] Patent Number: 4,852,505

[45] Date of Patent: Aug. 1, 1989

[54] TUFTING MACHINE HAVING AN INDIVIDUAL NEEDLE CONTROL SYSTEM

[76] Inventor: George D. Dedmon, 106 Lovella, Rte. 7, Ringold, Ga. 30736

[21] Appl. No.: 172,463

[22] Filed: Mar. 24, 1988

[51] Int. Cl.[4] ..... D05C 15/32

[52] U.S. Cl. ..... 112/80.42; 112/80.43

[58] Field of Search ..... 112/80.23, 80.24, 80.4, 112/80.41, 80.42, 80.43

[56] References Cited

U.S. PATENT DOCUMENTS

| | | | |
|---|---|---|---|
| 3,108,553 | 10/1963 | Beasley | 112/80.42 |
| 3,396,687 | 8/1968 | Nowicki | 112/80.41 |
| 3,665,873 | 5/1972 | Wittler | 112/80.42 |
| 4,366,761 | 1/1983 | Card | 112/80.41 |

*Primary Examiner*—Ronald Feldbaum

*Attorney, Agent, or Firm*—Pitts and Brittian

[57] ABSTRACT

An improved tufting machine (10) having an individual needle control system. The tufting machine (10) is designed for inserting yarns (26) into stitching in a base fabric (20). The tufting machine comprises a needle bar (28) mounted on a carrier (14) which is reciprocated in a plane which is substantially transverse to the plane of the base fabric (20) into which the yarn (26) is inserted. Insertion of the yarn is accomplished by needles (32 and 34) carried by the needle bar or bars (28). These needles penetrate the fabric (20) as the carrier (14) imparts reciprocating movement to the needles and their operatively associated needle bars. A control system is provided for adjusting the distal position of the individual needles during reciprocating movement such that the needles selectively penetrate the fabric (20) while the carrier (14) and the needle bar (28) are reciprocally operated.

10 Claims, 2 Drawing Sheets

TUFTING MACHINE HAVING AN INDIVIDUAL NEEDLE CONTROL SYSTEM

DESCRIPTION

1. Technical Field

This invention relates to tufting machines for inserting yarn into stitching in a base fabric, and more particularly concerns such a tufting machine incorporating a control system for adjusting the distal position of reciprocating needles individually such that the needles selectively penetrate the fabric into which the yarn is inserted.

2. Background Art

Tufting machines for forming geometric designs in patterned and tufted pile fabric have heretofore been known. Further, it has been known to employ different colored yarn, or to spin or twist different colored strands of rovings or yarn ends together to form colored multi-ply yarn inserted into a base fabric. Moreover, computer-controlled tufting machines are known in the art for producing multi-patterned designs. Traditionally, such computer-controlled machines employ a pattern designing computer and a double needle bar sliding machine. These machines can produce a variety of geometric patterns such as squares, diamonds, and sections of various lengths and pile heights. Multi-colored yarn can be threaded into the needles to enhance the aesthetic appeal of the computer-controlled patterns. One such known computer-controlled tufting machine is manufactured by Nakagawa Seisakusho (Mfg.) Co., Ltd. of Anoh, Age, Mie, Japan, and sold under the COMPUTUFT trademark. Other known machines generally relating to the field of the present invention are disclosed in the following U. S. Pat. Nos.: 3,056,364, issued to George D. Dedmon on Oct. 2, 1962; 3,162,155, issued to A. E. Charles on Dec. 22, 1964; 3,172,380, issued to J. H. Boules on Mar. 9, 1965; 3,247,814, issued to I. B. Polevitzky on Apr. 26, 1966; 3,259,088, issued to J. T. Rockholt on Jul. 5, 1966; 3,259,089, issued to J. T. Rockholt on Jul. 5, 1966; 3,641,955, issued to P. Brown, et al., on Feb. 15, 1972; 3,752,095, issued to P. Brown, et al., on Aug. 14, 1973; 3,881,432, issued to C. W. Dodd, et al., on May 6, 1975; 3,978,800, issued to R. T. Card, et al., on Sept. 7, 1976; 3,986,465, issued to R. P. Smith, et al., on Oct. 19, 1976; 4,064,816, issued to A. N. Spanel, et al., on Dec. 27, 1977; and 4,693,191, issued to J. L. Card, et al., on Sept. 15, 1987.

Certain machines capable of producing computer-designed patterns generally include mechanical latching mechanisms capable of selectively engaging the reciprocating needles with a driving member. These mechanical latching or connection members traditionally consume space, and require separation of adjacent needles by preselected amounts which cause a concomitant increase in the lowest gauge stitching capable of being performed by the tufting machine.

Accordingly, it is an object of the present invention to provide an improved tufting machine having an individual needle control system which adjusts the distal position of a reciprocating needle such that it can selectively penetrate a base fabric.

It is also a object of the present invention to provide such a tufting machine having an individual needle control which is compact such that the needles can be spaced close together to perform lesser gauge stitching. In one embodiment, the gauge can be reduced to ⅛ inch.

It is yet another object of the present invention to provide such an improved tufting machine having enhanced pattern generation capability.

DISCLOSURE OF THE INVENTION

Other objects and advantages will be accomplished by the present invention which provides an improved tufting machine having an individual needle control system for enhancing the pattern generation capability of the machine. The tufting machine includes at least one needle bar which is carried by a reciprocably driven carrier. A base fabric is supported in a plane substantially transverse to the reciprocation of the carrier. Needles are carried by a needle bar, and penetrate the fabric as reciprocable motion is imparted to the needles and the operatively associated needle bar through the carrier. The control serves to adjust the distal position of the needles during their reciprocating moves such that the needles selectively penetrate the fabric while the needle bars are reciprocated. By selectively penetrating the fabric, myriad patterns can be generated.

BEST MODE FOR CARRYING OUT THE INVENTION

Figure 1:
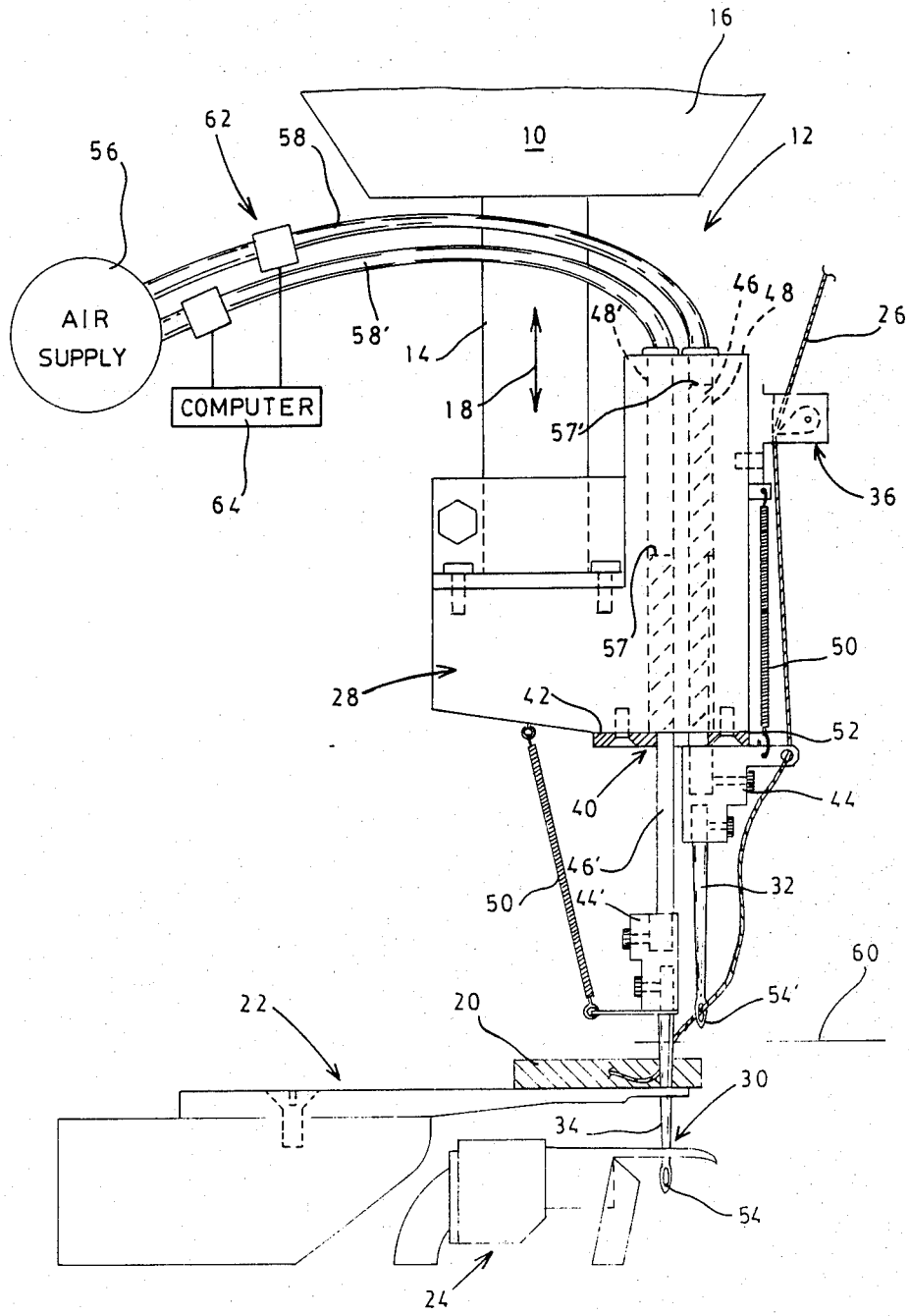
FIG. 1 illustrates a side elevation view of a portion of a tufting machine depicting features of the present invention which incorporates a needle control system for adjusting the distal position of needles during reciprocating movement.

The operative head portion of a tufting machine 10 is shown in the side elevation view of FIG. 1. This tufting machine 10 is preferably a computer-controlled tufting machine capable of generating pattern designs having selective geometric configurations. More specifically, the tufting machine 10 includes a tufting head portion 12 incorporating a reciprocating carrier 14 which is connected as illustrated in FIG. 1 to a stationary portion 16 of the tufting machine 10. This carrier 14 is reciprocably driven in the direction of the arrow 18 in a conventional manner to perform the sewing or stitching operations on a base fabric 20 which is supported by means generally indicated at 22. This support means 22 includes a conventional needle plate which supports the base fabric 20 in a plane substantially transverse to the reciprocation of the carrier 14. A conventional looper is indicated at 24. This looper is selectively operable as will be recognized by those skilled in the art.

In order to insert yarn indicated at 26 into the base fabric 20, the carrier 14 is provided with a needle bar generally indicated at 28. This needle bar 28 is releasably secured to the carrier 14, and reciprocates therewith as the carrier 14 moves in the direction of arrow 18. This needle bar 28 caries needle means generally indicated at 30. The illustrated needle means 30 comprises a pair of needles 32 and 34, respectively; however, it will be recognized that a multiplicity of substantially aligned needles will extend across the width of the tufting machine. The exemplary needles 32 and 34 are of conventional design, and include an eye at their distal end portion through which yarn 26 is threaded through yarn puller 36. Thus, when the needle bar 28 mounted on the carrier 14 is reciprocated in the direction of the arrow 18, the needles 32 and 34 are likewise reciprocated substantially transverse to the plane of the base fabric 20. The distance of the travel between the proximate position of the needle tip and the distal position of the needle tip is commonly referred to as the stroke.

An important feature of the invention is the provision of control means for adjusting the distal position of the needle means 30 during its reciprocating movement for selectively penetrating the base fabric 20 while said carrier reciprocates. More specifically, the control means adjusts the position of the stroke of individual needles on an axis substantially transverse to the plane of the fabric 20 such that the needles selectively penetrate the fabric. It will be noted that the fabric 20 is penetrated when the distal position of the needles in the stroke lies below the base fabric as shown in FIG. 1. To this end, control means generally indicated at 40 is provided. This control means 40 varies the beginning and end positions of the reciprocating needles 32 and 34 such that these needles selectively penetrate the fabric 20 eventhough the needles bar and the operatively associated carrier 14 reciprocate continuous during tufting operations.

Figure 2:
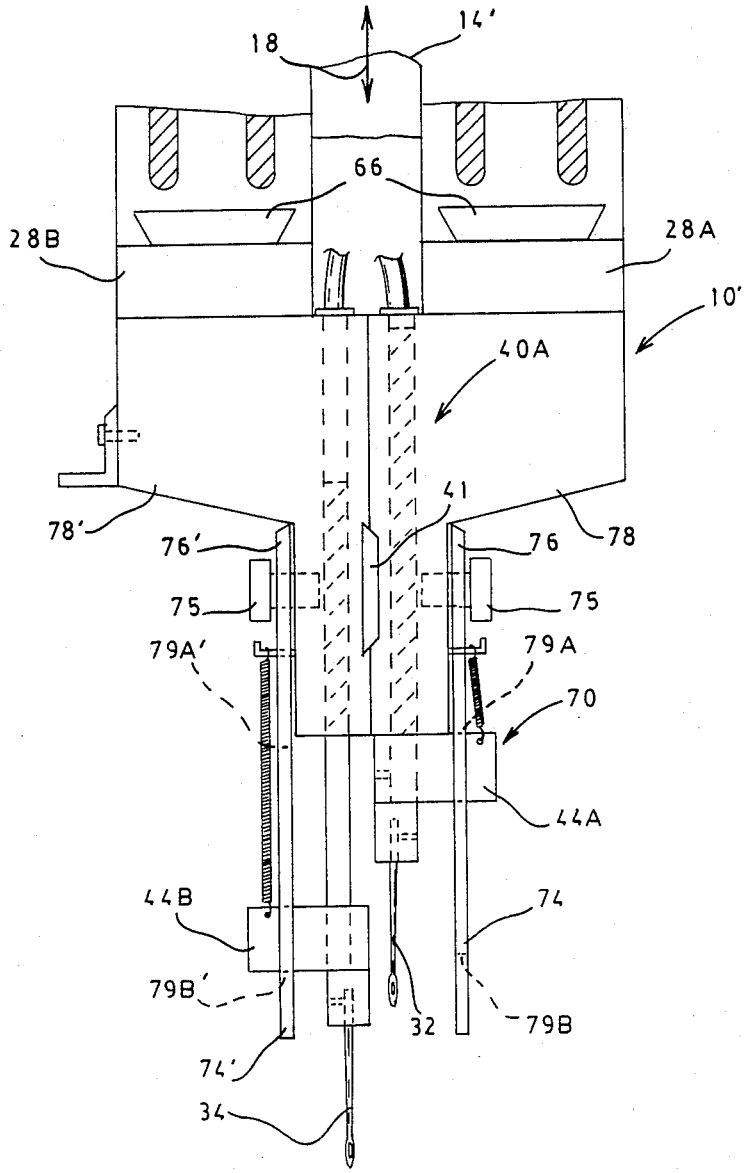
FIG. 2 illustrates a needle control system constructed in accordance with various features of the present invention and mounted on a tufting machine having sliding needle bars which further enhance the pattern generation capability of the machine.

The control means 40 in the preferred embodiment is operatively associated with each of the needles 32 and 34. Since the individualized components of the control means operatively associated with each of the needles is substantially similar, the control means component relative to needle 32 shall be described in detail and like components of the control means operatively associated with needle 34, or vice versa, shall be referred to at times with primed numerals. Similarly, like components in FIGS. 1 and 2 are referred to at times with primed numerals.

In order to vary the spacing between the needle bar 28, or for reference purposes, the lower surface 42 of the needle bar 28, with respect to the vertical position of the needle 32, this needle 32 is connected through a needle holder or coupling member 44 to an actuator means for adjusting the position of the individual needles' strokes. The actuator in the depicted embodiment comprises a piston member 46 having an arm which-supports the needle. It will be noted that this coupling member 44 also serves as a guide for the yarn 26 since it incorporates an eyelet as illustrated through which yarn is threaded prior to being threaded through the eyelet at the needle tip.

This piston member 46 is received in a chamber or cylinder 48 and defined in the needle bar 28. Spring member 50 serves to bias the coupling member 44, the operatively associated piston member 46 and needle 32 carried thereby to the position illustrated in FIG. 1 such that the coupling member 44 rests against a suitable stop 52 mounted as with the illustrated screw on lower surface 42 of the needle bar 28. In this position, the needle 32 will not penetrate the base fabric 20 as the carrier 14 and operatively associated needle bar 28 reciprocate in the direction of the arrow 18. In this connection, it will be recognized by those skilled in the art that the carrier 14 and needle bar 28 are in the lower most or distal position in FIG. 1. Thus, when the needle 32 is positioned such that the coupling member 44 rests against the stop 52 under the influence of the spring 50, the needle 32 does not insert the yarn into the base fabric 20 even though the needle bar 28 is reciprocally driven.

Preferably, stop members 42 and 52, slidably engage piston arm members 46' and 46 proximate the location at which these stop members are mounted in FIG. 1. The stop members serve to keep the needles from turning in their respective cylinders. To this end, the portions of the piston arm members 46' and 46 slidably engaged by the stop members 42 and 52, respectively, are flatened such that rotation is prohibited.

Needle 34, however, has had its vertical position with respect to the needle bar 28 adjusted by the control means 40 and incorporated actuator members 46' and 48' such that this needle will penetrate the base fabric 20 for the insertion of yarn (not shown with respect to needle 34 for purposes of clarity). The yarn will normally be threaded through the eye at the distal end portion 34 through a suitable eye carried by coupling member 44' which is of a design similar to coupling member 44, but rotated ninety degrees as shown in FIG. 1 such that the coupling members can slide past each other.

In order to adjust the stroke of the needle 34 on an axis transverse to the plane of the fabric 20 to position the distal end portion 54 of needle 34 at an extended location such that it penetrates the base fabric 20, actuator piston member 46' is extended. To this end, air from a suitable air supply 56 is fed through tubes 58 and 58' to cylinders 48 and 48', respectively. When air is injected into cylinder 48', this air acts against the rear face 57 of the sliding portion of the piston member 46 received within cylinder 48' forcing the distal end portion 54 of the needle 34 to the location depicted in FIG. 1 such that it penetrates the base fabric 20 as the carrier 14 reciprocates in the direction of the arrow 18. When air is not injected into a cylinder 48 or 48' (as shown here with respect to member 48), the spring 50 and/or 50' serves to bias the distal end portions 54 and 54' such that their distal position is represented by the plane 60 shown in FIG. 1. Thus, the fabric 20 is not penetrated.

In order to selectively control the injection of air from the air supply 56 into the cylinders 48 and 48' through operatively associated tubes 58 and 58', respectively, solenoid valves 62 are provided. These solenoid valves serve to selectively open and close the tubes 58 and 58' for the injection of air into the cylinders 48 and 48', respectively, thereby controlling the distal position of the needles 32 and 34 by adjusting the position of the stroke of the needles on an axis transverse to the plane of the fabric 20. The operation of the solenoid valves 62, which are of conventional design is controlled by a standard tufting computer 64. Such tufting computers such as can be operatively associated with the system as mentioned hereinabove, store pattern designs, and control tufting machines in accordance with the selected pattern designs stored in memory and often display designs to be produced on a conventional cathode ray tube.

It will be recognized by those skilled in the art that the control means 40 serves to adjust the distal position of the needles during the reciprocating movement of the carrier in the operatively associated needle bar 28 such that the needles, under the control of the computer, will selectively penetrate the fabric 20. This feature adds another dimension to the pattern designs which can be created by a tufting machine. Thus, patterns employing curved lines can be produced.

Referring now to FIG. 2, a control means generally indicated at 40A is shown. This control means 40A is constructed in a manner substantially similar to the control means 40 shown in connection with FIG. 1; however, in the embodiment depicted in FIG. 2, the control means is mounted on a tufting machine 10 having the needles 32 and 34 mounted on sliding needle bars 28A and 28B, respectively. Thus, needle bar 28A slides and reciprocates in a direction perpendicular to the plane of FIG. 2, and needle bar 28B slides and reciprocates along an axis perpendicular to the plane of FIG. 2. This sliding motion is accomplished by the provision of conventional slide locks 66. Moreover, it will be recognized by those skilled in the art that sliding needle bars of the type generally depicted in FIG. 2 are old i the art, and this figure is included to simply show that a control system incorporating various features of the present invention can be readily used by a tufting machine having sliding needle bars of the type shown in FIG. 2. A tufting machine having sliding needle bars with the control system 40A mounted thereon will have enhanced pattern designed capability since another dimension and movement, namely in a direction perpendicular to the plane of FIG. 2, is imparted to the needles as the tufting operation is undertaken.

The member 41 serves to keep the needle bar portions 78 and 78' together as they, and the operatively associated needle bars 28A and 28B, slide with respect to each other in a plane perpendicular to the plane of FIG. 2.

In one embodiment, the control means 40A shown in FIG. 2 incorporates an adjustable stroke guide means generally indicated at 70. The illustrated stroke guide means 70 shown in FIG. 2 incorporates a coupling member 44A which is operatively associated with needle 32, and a coupling member 44B which is operatively associated with needle 34. These coupling members are of a design similar to members 44 and 44' shown in FIG. 1, but they are slidably received within slotted plates 74 and 74' which act against the member, 44A and 44B, respectively, to keep the needles from turning. The plate slots extend from locations 79A and 79B on plate 74, and from locations 79A' and 79B' on plate 74'. The lower end of the slots (79B and 79B') serve as stops for the needles in the extended position by engaging the coupling members 44A and 44B, respectively. Similarly, the upper end portions (79A and 79A') of the slots serve to terminate the upward travel of the needles by engaging the coupling members 44A and 44B, respectively. A plurality of aligned slots will be spaced along the length of the slotted plates 74 and 74' to accommodate a plurality of needles and coupling members likewise spaced such that these coupling members will be received within the slots of the plates 74 and 74'. It is shown in FIG. 2 that the end portions 76 and 76' of plates 74 and 74', respectively, are releasably secured by the illustrated thumb screw members 75 on opposite sides of portion 78 and 78', respectively, of the sliding needle bars 28A and 28B, respectively. The plates 74 and 74' serve to guide the movement of the needles to and from their extended positions and fix those positions and further to assist in preventing deviation of that stroke from a preselected axis substantially transverse to the plane of the fabric 20.

From the foregoing detailed description, it will be recognized by those skilled in the art that an improved tufting machine having a control for individually adjusting the distal position of the needle during the reciprocating movement of the carrier has been provided. This control system allows an enhancement of the design producing capability of conventional tufting machines and particularly computer-controlled tufting machines. Further, it allows patterns, other than standard geometric patterns, to be produced by such tufting machines. Since the position of the needle with respect to the carrier and needle bar is adjusted, the needles can be placed in close proximity and the gauge with which stitching takes place reduced. Further, the system is designed to be readily installed and can be utilized with various types of tufting machines, including hose having sliding needle bars.

It will also be recognized that exemplary needles or needle pairs have been depicted within the figures by way of illustration. However, a multiplicity of needles will be provided in a conventional tufting machine, the exact number varying with the width of the carpet and the desired gauge. Thus, the control means will be operatively associated with each of the needles for which individual control is desired. Further, since the axis of the piston means and arm members to which the needles are attached is substantially coaxially aligned with the axis of the needles and its stroke (or is at least parallel thereto) in the preferred embodiment, the needles can be placed in closer proximity to each other than has heretofore been possible by conventional means employing latching techniques requiring cumbersome mechanical connectors selectively connecting the needles to the reciprocating needle bar.

While a preferred embodiment has been shown and described, it will be understood that there is no intent to limit the invention to such disclosure, but rather it is intended to cover all modifications and alternate constructions falling within the spirit and scope of the invention as defined in the appended claims. For example, while a pneumatic system has been described and illustrated for moving the needles to the desired vertical position during reciprocation of the carrier, other suitable means such as hydraulics, can be utilized.

I claim:

1. A tufting machine for inserting yarns into stitching in a base fabric:

at least one needle bar means;

a reciprocating carrier for the needle bar means;

means for supporting said base fabric in a plane substantially transverse to the reciprocating of said carrier;

needle means carried by said needle bar means for penetrating said fabric whereby reciprocation of said carrier imparts a reciprocating movement to said needle means which are moved along preselected axis substantially transverse to said plane of said base fabric; and control means for adjusting the position of the stroke of said needle means for selectively penetrating said fabric while said carrier reciprocates, said control means comprising selectively operable actuator means having a cylinder means and a piston member slidably received within said cylinder means, said piston member having an arm portion being releasably connected to said needle means, and air supply means for selectively injecting air into said cylinder means to position said needle means at a desired location for adjusting the stroke of said needle means.

2. The tufting machine of claim 1 including means for selectively supplying air to said cylinder means, said means comprising computer-controlled solenoid valves.

3. The tufting machine of claim 1 wherein said piston means and arm are substantially axially aligned with operatively associated said needle means.

4. The tufting machine of claim 2 wherein said cylinder means is defined in said needle bar means.

5. The tufting machine of claim 1 wherein said control means includes biasing means operatively associated with said needle means to further position said needle means at a desired location for adjusting the stroke of said needle means.

6. A tufting machine for inserting yarns into stitching in a base fabric:

at least one needle bar means;

a reciprocating carrier for the needle bar means;

means for supporting said base fabric in a plane substantially transverse to the reciprocation of said carrier;

needle means carried by said needle bar means for penetrating said fabric whereby reciprocation of said carrier imparts a reciprocating movement to said needle means which are moved along preselected axis substantially transverse to said plane of said base fabric; and control means for adjusting the position of the stroke of said needle means for selectively penetrating said fabric while said carrier reciprocates, said control means comprising selectively operable actuator means having a cylinder means and a piston member slidably received within said cylinder means, said piston member having an arm portion being releasably connected to said needle means, and air supply means for selectively injecting air into said cylinder means to position said needle means at desired location for adjusting the stroke of said needle means.

7. The tufting machine of claim 6 including means for selectively supplying air to said cylinder means, said means comprising computer-controlled solenoid valves.

8. The tufting machine of claim 6 wherein said piston means and arm are substantially axially aligned with operatively associated said needle means.

9. The tufting machine of claim 8 wherein said cylinder means is defined in said needle bar means.

10. The tufting machine of claim 6 wherein said control means includes biasing means operatively associated with said needle means to further position said needle means at a desired location for adjusting the stroke of said needle means.

* * * * *